US005827455A

United States Patent [19]

Nakai

[11] Patent Number: 5,827,455

[45] Date of Patent: Oct. 27, 1998

[54] ENGINE CHOKE CONTROL

[75] Inventor: Hiroshi Nakai, Hamamatsu, Japan

[73] Assignee: Sanshin Kogyo Kabushiki Kaisha, Hamamatsu, Japan

[21] Appl. No.: 655,691

[22] Filed: Jun. 3, 1996

[30] Foreign Application Priority Data

Jun. 2, 1995 [JP] Japan ..... 7-136645

[51] Int. Cl.[6] ..... F02M 1/12

[52] U.S. Cl. ..... 261/23.2; 123/179.18; 261/64.6

[58] Field of Search ..... 261/64.6, 23.2; 123/179.18

[56] References Cited

U.S. PATENT DOCUMENTS

| | | | |
|---|---|---|---|
| 2,127,653 | 8/1938 | Sisson . | |
| 2,446,352 | 8/1948 | Winter . | |
| 2,571,602 | 10/1951 | Neuser | 261/64.6 |
| 2,764,393 | 9/1956 | Geyer | 261/64.6 |
| 2,783,984 | 3/1957 | Kramer | 261/64.6 |
| 4,050,424 | 9/1977 | Nelson . | |
| 4,662,333 | 5/1987 | Martel . | |
| 4,788,014 | 11/1988 | Kanno | 261/64.6 |
| 5,326,293 | 7/1994 | Shishido et al. . | |
| 5,537,964 | 7/1996 | Hoshiba . | |

FOREIGN PATENT DOCUMENTS

| | | |
|---|---|---|
| 3-21551 | 3/1991 | Japan . |

*Primary Examiner*—Tim R. Miles
*Attorney, Agent, or Firm*—Knobbe, Martens, Olson & Bear, LLP

[57] ABSTRACT

An engine choke actuation system automatically controls both the opening degree of the choke and throttle valves of a plurality of charge formers during all phases of engine warmup. The engine choke actuation system also includes a manual override mechanism which allows the associated choke valves to be opened manually in case of a system malfunction.

14 Claims, 3 Drawing Sheets

ENGINE CHOKE CONTROL

BACKGROUND OF THE INVENTION

1. Field of the Invention

The present invention relates in general to an internal combustion engine, and more particularly to an engine cold start control device.

2. Description of Related Art

To start an engine efficiently and effectively, the fuel/air ratio of a fuel charge delivered to the engine should be controlled both at the time of starting the engine and during the time the engine warms to its designed operating temperature. When starting a cold engine, the fuel charge should contain a higher concentration of fuel because some percentage of the fuel will condense on the cool induction system of the engine before the fuel charge is delivered to the combustion chambers of the engine. The initial ratio of the fuel to air thus must be richer in order to supply a charge having the proper fuel-to-air ratio.

Conventional charge formers use various types of cold starting devices to produce a richer charge when starting a cold engine. For instance, a choke valve is used in a conventional carburetor to decrease air flow into a mixture chamber of the carburetor, and consequently the concentration of fuel in the charge is increased. It is known to adjust the choke valve to tailor the opening degree of the choke valve to the starting temperature of the engine in order to compensate for variable starting temperatures. Colder starting temperatures require a smaller opening degree (i.e., less air flow) in order to produce a rich charge, and warmer starting temperatures require a larger opening (i.e., more air flow) to produce a less rich charge.

Some prior cold-start devices which employ a choke valve or similar device automatically adjust the position of the choke valve depending upon engine temperature. In some of these prior devices, however, the choke valves can stick in the closed or a substantially closed position, which can stall the engine. Normally an engine cannot continue to run with the choke valve fully closed. A malfunction of the prior cold-start device therefore can render the engine inoperable and strand the watercraft at a remote location.

SUMMARY OF THE INVENTION

A need therefore exists for a manual override mechanism for an engine choke control system which allows the associated choke valves to be opened manually in case of a system malfunction.

One aspect of the present invention thus involves an engine choke actuation system for use with a plurality of choke devices. The system comprises a linkage which interconnects the choke devices so as to operate the choke devices generally in unison. The linkage includes a plurality of interconnected linkage rods. Each rod is connected to at least one of the choke devices to operate the choke devices between a closed position and an open position. An end of at least one of the linkage rods is readily detachable from the corresponding choke device. A hook is positioned near the detachable end of the linkage rod and is configured to receive the detachable end of the linkage rod. The choke device is opened with the detachable end inserted into the hook.

In accordance with another aspect of the present invention, an engine choke actuation system is used with a plurality of choke devices. The system comprises a linkage which interconnects the choke devices so as to operate the choke devices generally in unison. The linkage includes a plurality of interconnected linkage rods. Each rod is connected to at least one of the choke devices to operate the choke devices between a closed position and an open position. Means for manually operating the linkage are provided to open at least a majority of the choke devices.

A preferred method of manually operating an engine choke actuation system is provided. The system comprises a linkage which interconnects a plurality of choke devices. The linkage comprises a plurality of choke levers interconnected by linkage rods. The choke levers operate the choke shafts of the choke devices to operate the choke devices between an open and a closed position. The method involves disconnecting one end of one of a linkage rod of the linkage from an associated choke lever and moving the disconnected end to a position near a hook of the engine choke actuation system. This movement opens at least some of the choke devices. The disconnected end is then engaged with the hook to maintain the opened choke devices in the open position.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
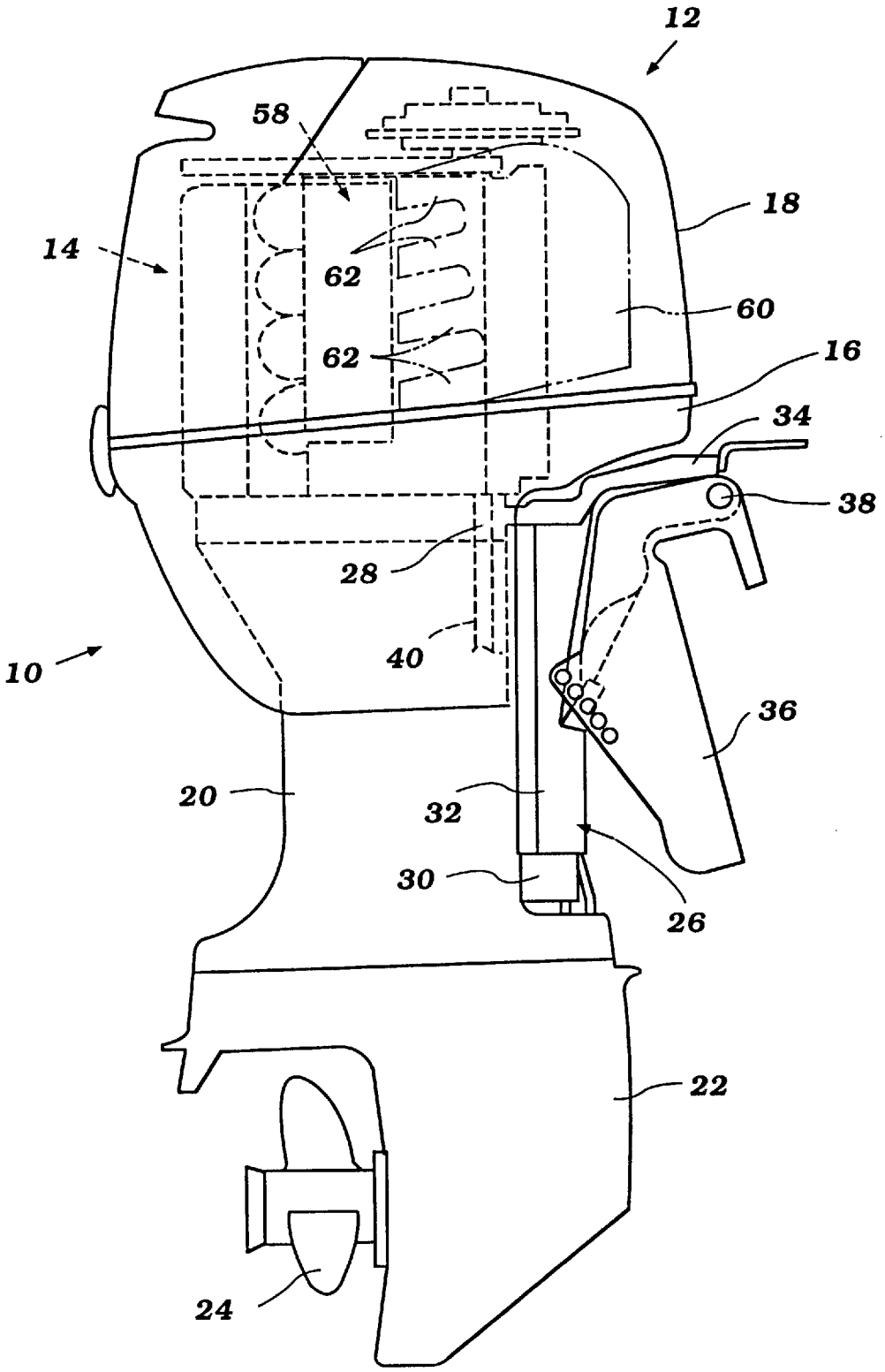
FIG. 1 is a side elevational view of an outboard motor having an engine incorporating an choke control configured in accordance with a preferred embodiment of the present invention.

FIG. 1 illustrates a conventional marine outboard drive 10 of the type in which the present choke control can be incorporated. The present choke control mechanism has particular utility with vertically oriented engines commonly employed in outboard motors. The inventive choke control mechanism thus is described in connection with an outboard motor; however, the depiction of the invention in connection with an outboard motor is merely exemplary. Those skilled in the art will really appreciate that the present choke control can be applied to an inboard motor of an inboard/outboard drive, to an inboard motor of a personal watercraft, and to other types of watercraft engines as well.

In the illustrated embodiment, the outboard drive 10 includes a power head 12, formed in part by an engine 14. a conventional cowling surrounds the engine 14. The cowling desirably includes a lower tray 16 and an upper cowling member 18. These components of the protective cowling 16, 18 together define an engine compartment which houses the engine 14.

A drive shaft housing 20 extends downwardly from the lower tray and terminates in a lower unit 22. The lower unit 22 can house a transmission (not shown) which selectively establishes a driving condition for a propulsion device 24, such as, for example, a propeller. The transmission desirably is a forward-neutral-reverse type transmission. In this manner, the propulsion device can drive the associated watercraft in any of these operating states.

A steering shaft assembly 26 is affixed to the drive shaft housing 20 at upper and lower brackets 28, 30. The brackets 28, 30 support a steering shaft for steering movement within a swivel bracket 32. Steering movement occurs about the generally vertical steering axis which extends through the steering shaft. A steering arm 34, which is connected to an upper arm of the steering shaft, can extend in a forward direction for manual steering of the outboard drive 10, as known in the art.

The swivel bracket 32 is also pivotally connected to a clamping bracket 36 by a pin 38. A clamping bracket 36, in turn, is configured to attach to the transom of the associated watercraft. This conventional coupling permits the outboard drive 10 to be pivoted relative to the pin 38 to permit adjustment of the trim position of the outboard drive 10 and for tilt-up of the outboard drive 10.

Although not illustrated, it is understood that a conventional hydraulic tilt and trim cylinder assembly, as well as a conventional hydraulic steering cylinder assembly can be used as well with the present outboard drive 10. The construction of the steering and trim mechanism is considered to be conventional and, for that reason, further description is not believed necessary for an appreciation and understanding of the present invention.

The engine 14 is mounted conventionally with its output shaft or crankshaft 39 (FIG. 2) rotating about a generally vertical axis. The crankshaft drives a drive shaft 40 (FIG. 1) which depends from the power head 12 of the outboard motor 10 and extends through and is journaled within the drive shaft housing 20. The drive shaft 40 depends into the lower unit 22 to drive a drive gear of the transmission (not shown).

The engine 12 desirably is a four-stroke, in-line, four-cylinder combustion engine. It will be readily apparent to those skilled in the art, however, that the invention may be employed with engines having a different number of cylinders, having other cylinder orientations, and/or operating on other than a four-stroke principle, such as, for-example, a two-stroke, crankcase compression principle.

Figure 2:
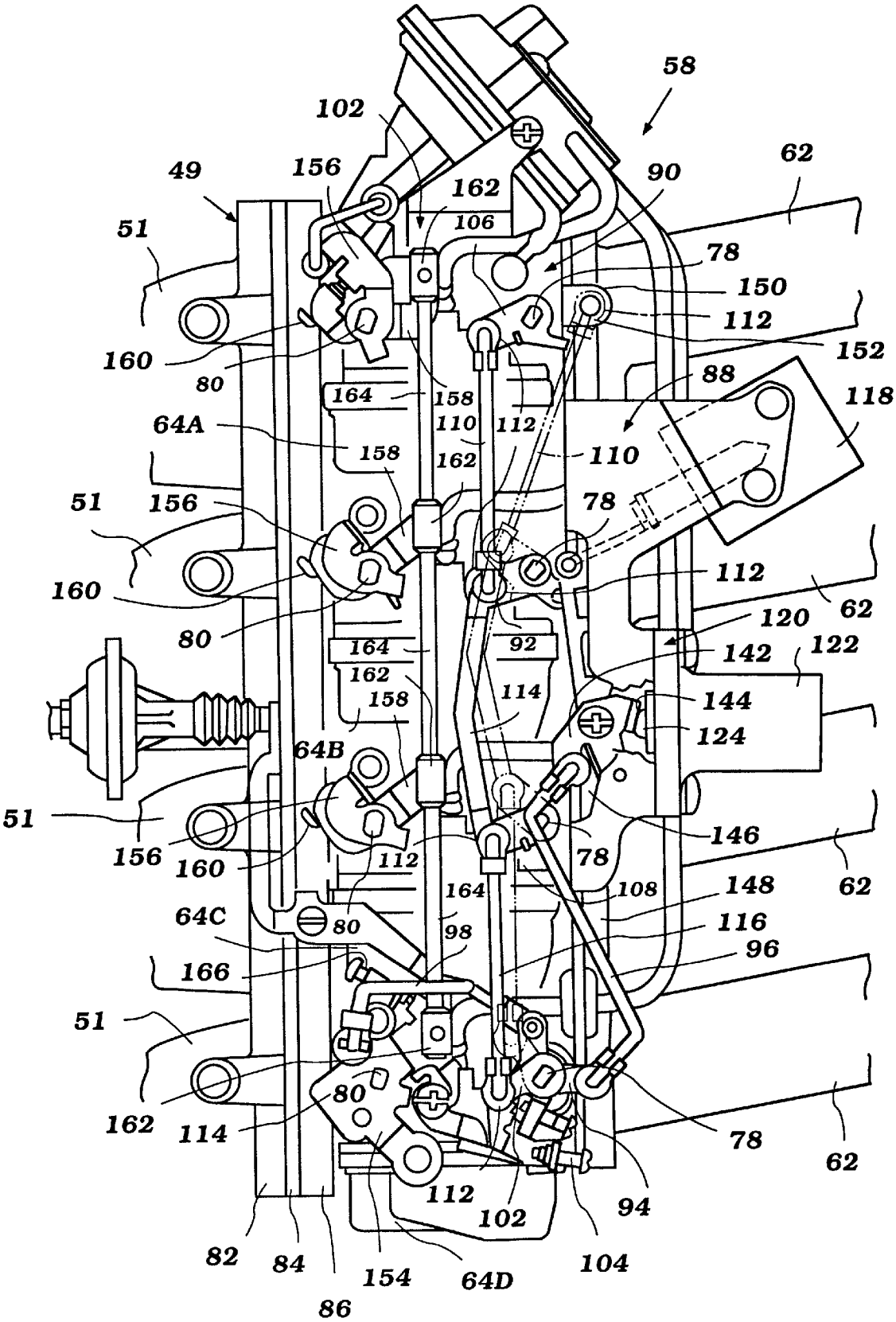
FIG. 2 is an enlarged, partial side elevational view of the engine choke control of FIG. 1 together with an associated induction system.

The engine 12 includes an induction system 58. As seen in FIGS. 1 and 2, the induction system 58 includes an intake silencer 60 which is disposed to the front side of the power head 12 and on one side of the crankcase member 44. The intake silencer 60 draws air into the engine through at least one air inlet from the interior of the cowling and silences the intake air charge.

As seen in FIGS. 1 and 2, a series of induction pipes 62 deliver air from the intake silencer 60 to a plurality of charge formers 64. The lengths of the induction pipes 62 desirably are tuned with the intake silencer to minimize the noise produced by the induction system 58, as known in the art.

The charge formers produce a charge of air and fuel which is delivered to the plurality of runners 51 of an intake manifold 49. In the illustrated embodiment, the charge formers 64 are a plurality of vertically aligned carburetors, each connected to one of the induction pipes 62. It should be understood, however, that although the invention is described in conjunction with a carbureted engine, certain facets of the invention may be employed in connection with other types of charge formers, such as fuel injectors or the like. For ease of description, each carburetor will be designated by an A, B, C, or D suffix, identified from the top down, and the collection of carburetors shall be designated generally by reference numeral 64 without suffix.

Figure 3:
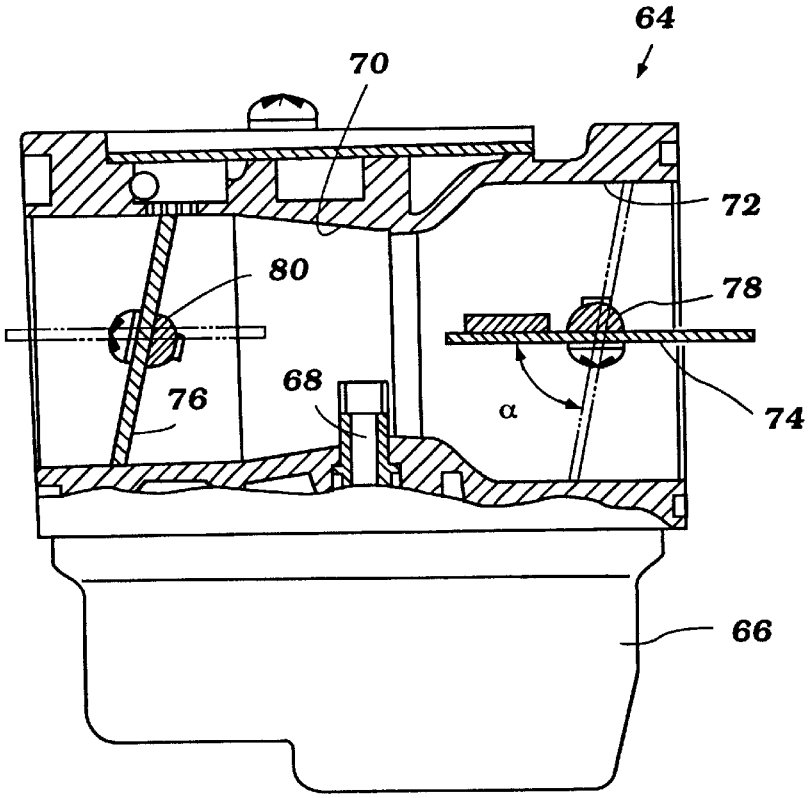
FIG. 3 is a partial sectional, side elevational view of a carburetor of the induction system of FIG. 2.

The carburetors 64 may be of any known type and construction. For instance, FIG. 3 illustrates one exemplary carburetor 64. The carburetor includes a fuel bowl 66 to which fuel is emitted through a float control valve (not shown) so as to maintain a uniform head of fuel therein. A main discharge tube 68 delivers fuel from the fuel bowl 66 to a Venturi restriction 70 in an air horn 72 of the carburetor body.

Each carburetor 64 also has a choke valve 74 and a throttle valve 76 to regulate the mixture of fuel and air to each cylinder of the engine 12, as known in the art. A choke shaft 78 supports the choke valve 74 within the air horn 72 of the carburetor 64 and controls the opening degree of the choke valve 74, as known in the art. In the illustrated embodiment, the choke valve 74 desirably is an offset butterfly-type valve, and rotation of the choke shaft 78 moves the choke valve 74 between a closed position and a full open position. The choke shaft 78 thus controls the angle of the choke valve 74 relative to the closed position (i.e., controls the choke angle). FIG. 3 illustrates the choke valve 74 in a wide-open position. Although the invention is described in connection with a butterfly-type valve, it is understood that the present invention can be used equally well with other types of choke valves, such as, for example, slider-type valves.

FIG. 3 also illustrates a throttle shaft 80 of the carburetor 64 which supports the throttle valve 76 within the air horn 72 of the carburetor 64. Like the choke valve 74, the throttle valve 76 desirably is a butterfly-type valve; however, it is understood that other types of valves, such as slider valves, can be used as well. Rotation of the throttle shaft 80 controls the orientation of the throttle valve 76 within the air horn 72, as known in the art.

As seen in FIG. 2, the carburetors 64 are attached between the induction pipes 64 and the runners 51 of the intake manifold 49. The carburetors 64 are attached to an intake manifold flange 82 by means that include a common insulator assembly 84, such that each carburetor 64 delivers a charge to the corresponding intake runners 51 of the intake manifold 49. A suitable insulator assembly disclosed in U.S. Pat. No. 5,551,385, issued Sep. 3, 1996 and assigned to the assignee hereof, which is hereby incorporated by reference.

The carburetors 64 are attached to the corresponding runners 51 by means that include a common mounting plate 86. The common mounting plate 86 is attached to the manifold flange 82 in a known manner. On the opposite side of the carburetors 64, i.e., the inlet side, the carburetors 64 are attached to the outlet of the induction pipes 62 in a known manner.

FIG. 3 illustrates an engine choke actuation system 88 configured generally in accordance with the description provided in U.S. Pat. No. 5,537,964, issued Jul. 23, 1996, and assigned to the assignee hereof, which is hereby incorporated by reference.

A choke linkage 90 interconnects the choke shafts 78. The choke linkage 90 includes a series of choke levers interconnected by a plurality of linkage rods. The linkage rods interconnect the ends of the choke levers at a point distanced from the choke shafts 78 with conventional clips connecting the ends of the linkage rods to the choke levers.

In the illustrated embodiment, the choke linkage 90 includes a generally L-shaped choke lever 92 attached to one of the choke shafts 78. The L-shaped choke lever 92 desirably is attached to the choke shaft 78 of the second carburetor 64B.

The choke linkage 90 also includes a carrier choke lever 94 which carries an end of a choke angle control rod 96, as discussed in detail below. In the illustrated embodiment, the carrier choke lever 94 is attached to the choke shaft 78 of the fourth carburetor 64D, although it is understood that other locations are also possible. The carrier choke lever 94 generally has an L-shape and includes a first aperture at an intersection between two legs. The first aperture receives the choke shaft 78 of the fourth carburetor 64D to secure together the carrier choke lever 94 and the choke shaft 78. One end of the carrier choke lever 94 includes a second aperture used to interconnect the carrier choke lever to the choke angle control rod 96, and the other end connects to a link 98 that interconnects the choke linkage 88 to a throttle linkage 100.

The choke shaft 78 of the fourth carburetor 64D also supports an additional choke lever 102, which also has an L-shape. The choke lever 102 includes an aperture which receives the end of the choke shaft 78 to fix the choke lever 102 to the shaft 78. A second aperture lies at about the intersection between the legs of the L-shaped choke lever 102. The aperture receives a portion of the linkage rod, as described below. The choke lever 102 also includes an abutment surface which cooperates with an adjustment screw 104. The adjustment screw 104 can be used to alter the angular position of the choke valves 74 (i.e., to change angle $\alpha$ of FIG. 3) when the choke control mechanism 88 closes the choke valves 74.

Conventionally shaped choke levers 106, 108 are attached to the balance of the choke shafts 78. In an illustrated embodiment, these choke levers are attached to the choke valve shafts 78 of the first and third carburetors 64A, 64C.

Linkage rods interconnect the ends of the choke levers at points distal of the choke shafts 78. In the illustrated embodiment, a first linkage rod 110 extends between the distal end of the first and second choke levers 106, 92. Conventional clips 112, which engage apertures on the distal end of the choke levers 106, 92, connect the ends of the first linkage rod 110 to the first and second choke levers 106, 92. The first linkage rod 110 desirably has a standard cylindrical shape.

A second linkage rod 114 extends between the distal ends of the second and third choke levers 92, 108. The second linkage rod 114 desirably has a flattened cross-sectional shape and includes an aperture at each of its ends to cooperate with the second and third choke levers 92, 108. Clips 112 connect an upper end of the second throttle rod 114 to the second choke lever 92 and to the lower end of the first throttle rod 110, and connect the lower end of the second throttle rod 114 to the end of the third choke lever 108 and to the upper end of a third linkage rod 116. In the illustrated embodiment, the second linkage rod 114 is bent along its longitudinal length to provide clearance for the operation of other components of the choke actuator control mechanism 88.

The third linkage rod 116 extends between the distal ends of the third choke lever 108 and the choke lever 102 of the fourth carburetor 64D. A lower end of the third lever rod 114 inserts through the aperture of the choke lever 102. A conventional clip 112 connects the lower end of the third linkage rod 116 to the end of the choke lever 102. The third linkage rod 116 has a conventional cylindrical shape.

A choke solenoid 118 is coupled to the choke linkage 90 to operate the choke shafts 78 in unison. In the illustrated embodiment, the solenoid 118 is attached to an L-shaped choke lever 92 coupled to the second choke shaft 78; however, it is understood that the choke solenoid 118 and the corresponding L-shaped choke lever 92 can be positioned on any choke shaft 78, provided that the position also accounts for the spacing demands of the engine layout. The first and second linkage rods 110, 114 are attached to end of the other leg of the L-shaped choke lever 92, with the choke shaft 78 being positioned at the intersection of the two legs. In this manner, the solenoid 118 rotates the choke shaft 78 in one direction to close the choke valve 74 by pulling on the end of the first leg of the choke lever 92. This movement rotates the choke lever 92 about the axis of the choke shaft 78, which forces the choke linkage 88 to move. The choke linkage 88 in turn rotates the other choke shafts 78 in the same direction and to the same degree.

Although not illustrated, a torsion spring is coupled to some or all of the choke levers to bias the-choke valves 74 toward an open position. That is, the spring biases the choke shaft 78 and the choke linkage 88 in the direction opposite to that in which the solenoid 94 pulls the choke linkage 88 and rotates the choke shafts 78.

FIG. 2 also illustrates a choke control mechanism 120 which controls the opening degree of the choke valves 78 at all phases during engine warmup (i.e., during the engine start phase and during the engine warmup phase). The choke control mechanism 120 includes an actuator 122 with an extendable plunger 124. The extent to which the plunger 124 extends from the actuator 122 desirably corresponds to the temperature of the engine 12, and more preferably corresponds to the temperature of an induction system 58 of the engine 12.

A variety of known actuator devices can be used for this purpose. For instance, in the illustrated embodiment, the actuator 122 is a conventional wax pellet used with a positive temperature coefficient (PTC) device 123.

Figure 4:
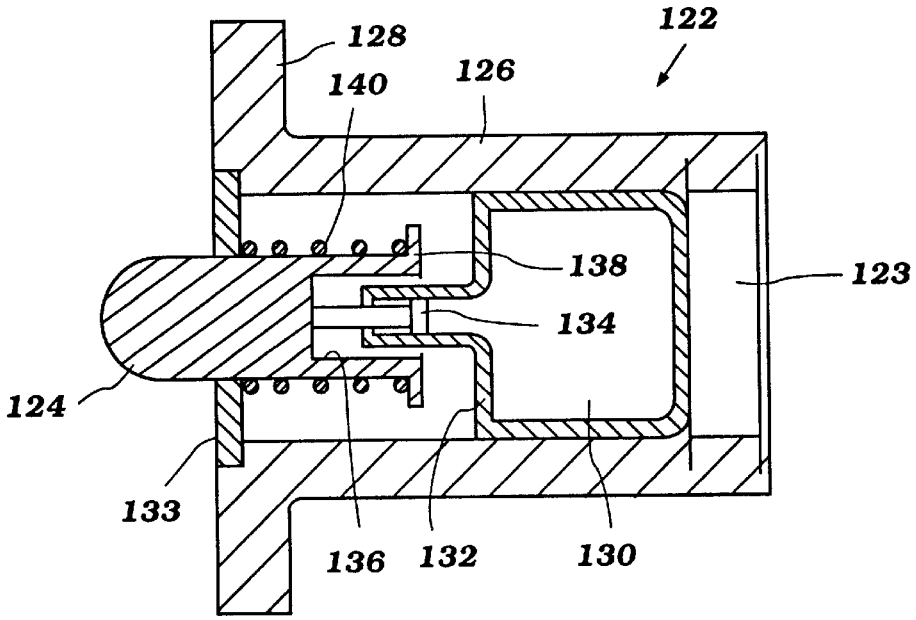
FIG. 4 is an enlarged cross-sectional view of an actuator of the choke control of FIG. 2.

With reference to FIG. 4, the wax pellet 122 includes a generally tubular body 126 which terminates in an annular flange 128 used for mounting purposes. A reservoir of wax 130, which is housed within a container 132, is positioned within the tubular body 126. The plunger 124 extends from the end of the tubular body 126. A plate 133 seals the end of the body 126, with the plunger 124 extending through an apertures 124 in the plate 133.

The plunger 124 includes a piston 134 which rides in a cylinder formed at the end of the wax reservoir container 132. The plunger 132 also includes an inner bore 136 which generally surrounds the cylindrical portion of the wax reservoir container 132. An annular flange 138 surrounds an end of the plunger approximate to the inner bore 136. A compression spring 140 is disposed between the annular flange 138 and the end plate 133 which encloses an end of the tubular body 126.

The PTC device 123 is placed adjacent the wax reservoir 130 at the end of the actuator 122 opposite the plunger 124. The PTC device 123 desirably is tuned such that the rise rate in temperature produced by the PTC device 123 generally matches that of the engine 12, and more particularly the induction system 58. As discussed below, the PTC device 123 heats the wax reservoir 130. As the wax expands, the wax forces the piston 134 in a direction out of the container 132. As a result, the plunger 124 compresses the spring 140 and extends from the actuator housing 126. When the wax cools with decreasing temperature, the spring biases the plunger 124 back into the housing 126.

With reference to FIG. 2, the actuator 122 acts upon a movable cam 142 which rotates about a support shaft. The movable cam 142 includes a tang 144 which is distanced from the axis of rotation of the cam 142 and forms an abutment surface upon which the actuator plunger 124 acts. The movable cam 142 also defines a plurality of camming surfaces which cooperate with a guide slot of a support plate 146. The movable cam 142 is positioned above the fixed support plate 146. Rotation of the cam member 142 about the support shaft varies the overlap pattern between the guide slot of the fixed support plate 146 and the space defined between the camming surfaces of the movable cam 142.

The choke control rod 96 includes a follower which is captured between the fixed support plate 146 and the movable cam 142 within the space defined by the overlap between the guide slot and the space between the cam surfaces of the movable cam 142. The follower desirably is a roller which rotates over the edges of the first and second cam surfaces and/or over an edge surface of a guide slot defined by the fixed support plate 146. The follower is attached to an end of the control rod 92. Alternatively, the choke control rod 96 can be directly attached to the movable cam 142 to move with the cam 142. An opposite end of the control rod is attached to an end of the carrier lever 94.

The choke solenoid 118, actuator 122, cam 142, and support plate 146 desirably are mounted to the engine proximate to the carburetors 64, and more preferably are attached to a support bracket 148, which also interconnects the carburetors 64. A suitable mounting arrangement and assembly is disclosed in U.S. Pat. No. 5,524,596 issued Jun. 11, 1996 the assignee hereof, which is hereby incorporated by reference.

As seen in FIG. 2, the support bracket 148 includes a hook 150. The hook 150 lies near the position of the choke shaft 78 of the first carburetor 64A. The position of the hook 150 desirably is such that with the second choke lever 92 in an open position, the hook 150 lies at a distance from the end of the second choke lever 92, which substantially equals the length of the first linkage rod 110. The hook 150 includes an aperture which is sized to receive a transversely bent end of the first linkage rod 110 and to cooperate with the clip 112 to releasably secure the linkage rod 110 to the hook 150.

The clip 112, which connects the upper end of the linkage rod 110 to the upper choke lever 106, is readily detachable from the lever 106. The clip also is readily detachable from the hook 150. In this manner, the upper linkage rod 110 can be easily moved by hand between a position in which its upper end is connected to the upper choke lever 106 and a position in which in upper end is connected to the hook 150. The linkage rod 110 moves the choke lever 92 at its lower end to an open position with its upper end interacting with the hook 150, as described below.

The choke control mechanism 88 also acts upon the throttle shafts 80 of the carburetors 64 to open the throttle valves 76 to a greater degree than at an idle position during the phases of engine starting and warmup. For this purpose, the link 98 connects the carrier lever 94 to a portion of a throttle linkage 100. In the illustrated embodiment, the link 98 connects to a throttle lever 154 attached to the throttle shaft 80 of the fourth carburetor 64D.

With reference to FIG. 2, the throttle linkage 100 is formed in part by a plurality of throttle levers interconnected by a series of throttle rods. In the illustrated embodiment, throttle levers attached to the throttle shafts 80 of the three upper carburetors 64A, 64B, 64C are substantially identical, and the following description of one is understood as applying to all, unless specified to the contrary.

As seen in FIGS. 3 and 5, a first throttle lever is attached to the throttle shaft 80 of the upper carburetor 64A. First and second segments 156, 158 of the throttle lever are fixed onto the throttle shaft 80 by inserting the throttle shaft 80 through apertures in the lever segments 156, 158. The first segment 156 extends away from the throttle shaft end 80 and cooperates with an adjustment screw 160. A torsion spring 126 biases the first segment 156 toward the closed position. The adjustment screw 160 limits the rotation of the throttle lever segment 156 in this direction and is used to synchronize the position of the throttle valves 76 when in the closed position.

A clip 162 connects an end of the second throttle lever segment 158 to the throttle rod 164. In the illustrated embodiment, the clip 164 cooperates with a snap connector (not shown) formed on the end of the lever segment 158.

The clip 162 of the middle levers also interconnects the linkage rod 164 to the levers 158 of the middle carburetors 64B, 64C.

In the illustrated embodiment, the throttle lever 154 of the lower carburetor 64D acts as a lead throttle lever and operates the throttle linkage 100, as described below. The lead throttle lever 154 generally has an L-shape, with an aperture receiving the throttle shaft 80. The lever 154 is fixed to the end of the associated throttle shaft 80.

One leg of the lead throttle lever 154 includes a coupling to which a throttle operator mechanism is coupled. The throttle shaft 80 thus rotates with the lead throttle lever 154 about the axis of the throttle shaft 80.

As best seen in FIG. 2, the other leg of the lead throttle lever 154 includes an abutment surface for contact with a throttle adjustment screw 166 that defines the idle position of the throttle valve 76, as known in the art. The link 98 between the choke control mechanism 88 and the lead throttle lever 154 also connects to the this leg of the lever 154. The link 98 establishes a fast idle position of the throttle valves 76, as described in U.S. Pat. No. 5,537,964 incorporated by reference above.

A clip 162 connects the linkage rod 164 to the outer end of the second leg of the lead throttle lever 154. The clip 162 interconnects with a snap connector in the manner described above. Rotation of the second leg of the lead throttle lever 154 about the axis of the associated throttle shaft 80 moves the throttle linkage 100 up or down. In the illustrated embodiment, clockwise rotation moves the throttle linkage 100 down to open the throttle valves 76, and counterclockwise rotate moves the throttle linkage 100 up to close the throttle valves 76. In this manner, the throttle linkage 100 synchronizes the operation of the throttle shafts 80.

The choke actuation system 88 controls the opening degree of the choke valves 74 and the fast idle angle of the throttle valves 76 when the engine is initially started and during engine warm up. When starting the engine, the solenoid 118 closes the choke valves 74 of the charge formers 64. The solenoid 118, when energized, pulls the L-shaped choke lever 92 to rotate the choke lever 92 and the corresponding choke shaft 78. In an illustrated embodiment, the solenoid 92 rotates the choke lever 92 in the counterclockwise direction. The choke lever 92 communicates this rotational movement to the other choke shafts 78 as the choke lever 92 forces the linkage 90 in the downward direction. The extent to which the solenoid 118 can rotate the choke valves 74, however, is limited by movement of the follower in the guide slot of the fixed member 146. This is because the choke control rod 96 links the choke levers and choke shafts 78 to the follower. The actuator 122 controls the degree to which the follower can move within the guide slots by controlling the position of the cam member's first and second cam surfaces relative to the guide slot.

The present choke actuation system 88 also controls the fast idle angle of the throttle valves 76 according to the engine's starting temperature. As seen in FIG. 2, the fast idle control rod 98 communicates the position of the cam member 142 to the throttle linkage 100. As the cam member 142 rotates in one direction, the carrier lever 94 rotates about the lower choke shaft 78 in the opposite direction. In the illustrated embodiment, counterclockwise rotation of the cam member 142 rotates the carrier lever 94 in the clockwise direction. This rotation in the carrier lever 94 rotates the throttle linkage 100, and thus the throttle shafts 80 clockwise, thereby increasing the opening degree of the throttle valves 76. The increased opening degree over the normal idle angle of the throttle valves 76 establishes a fast idle position.

After engine starts, an engine control unit (ECU) de-energizes the solenoid 118 and energizes the PTC heater 123 of the choke control mechanism 120. When the ECU shuts off the solenoid 118, the choke actuation mechanism 88 allows the choke valves 74 to open to the desired running angle as established by the actuator 122. The choke control mechanism 88 then increases the opening degree of the choke valves 74 at a steady rate as the engine 12 warms. The choke control mechanism 88 also steadily decreases the fast idle angle back to its normal idle angle. The choke control mechanism 88 fully opens the choke valve 74 and decreases the fast idle angle back to its normal idling position once the engine 12 has warmed to a designed operating temperature.

The operation of the choke control and cold start mechanism is further described in U.S. Pat. No. 5,537,964, which has been incorporated by reference above. It is not believed necessary for an appreciation of the present invention to provide a further description of this operation beyond that provided above.

In the event that the choke control and cold start mechanism 88 malfunctions and the choke valves 74 stick shut, the present system 88 allows manual operation of the choke valves 74 to open at least the choke valves 74 of the second, third, and fourth carburetors 64B, 64C, 64D. To manually open these choke valves 74, the upper end of the first linkage rod 110 of the choke linkage 90 is disconnected from the first choke lever 106. The upper end of the first linkage rod 110 is then moved to position its transversely bent upper end to extend into the aperture 152 of the support bracket hook 150. In so doing, the first linkage rod 110 moves the second lever 92 to a position which rotates the choke shaft 78 in the clockwise direction and opens the associated choke valve 74. The second and third linkage rods 114, 116 communicate the clockwise rotation to the corresponding levers 108, 102. Consequently, the third and fourth choke valves 74 simultaneously open with the choke valve of the second carburetor 64B. FIG. 2 illustrates in phantom lines the position of the choke linkage 90 in this manually operated position. The clip 112 of the upper end of the first linkage rod 110 can engage the opening 152 of the hook 152 to maintain the choke linkage system 90 in this position and hold the choke valves 74 open until the engine 12 can be serviced by a technician.

In this manner, the present choke control system 88 provides a manual override to control the choke valves 74 and to allow the engine 12 to operate should the choke control system 88 malfunction. The manual override allows engine 12 operation to enable the associated watercraft to return to dock or land for repair.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. An engine choke actuation system for use with a plurality of choke devices comprising a linkage which interconnects said choke devices so as to operate said choke devices generally in unison, said linkage comprising a plurality of interconnected linkage rods each of which connects to at least one of said choke devices to operate said choke devices between a closed position and an open position, an end of at least one of said linkage rods being readily detachable from the corresponding choke device, and a hook positioned near said detachable end of the linkage rod and configured to receive said detachable end of said linkage rod, the corresponding choke device being positioned in said open position with said detachable end inserted into said hook.

2. An engine choke actuation system as in claim 1, wherein said plurality of choke devices are aligned above one another in a generally vertical orientation, and said detachable linkage rod end cooperates with an uppermost choke device of said plurality of said choke devices.

3. An engine choke actuation system as in claim 2, wherein each choke device forms part of a charge former.

4. An engine choke actuation system as in claim 2, wherein a bracket interconnects said choke devices together, and said hook is formed on said bracket.

5. An engine choke actuation system as in claim 1, wherein said throttle linkage additionally comprises a plurality of choke levers connected to choke shafts of said choke devices, said choke levers being interconnected by said linkage rods.

6. An engine choke actuation system as in claim 5, wherein said hook is distanced from at least one of said choke levers by a distance which generally equals a length of one of said linkage rods.

7. An engine choke actuation system as in claim 6, wherein said hook lies adjacent to another one of said choke levers.

8. An engine choke actuation system as in claim 5, wherein a first linkage rod of said plurality of linkage rods interconnects first and second choke levers of said plurality of choke levers with said detachable end coupling said first linkage rod to said first choke lever.

9. An engine choke actuation system as in claim 8, wherein said hook lies adjacent to said first choke lever and is spaced from an end of said second choke lever to which said first linkage rod is attached by a distance substantially equal to the length of said linkage rod.

10. An engine choke actuation system as in claim 5, wherein a clip attaches said end of said linkage rod to one of said choke levers in the readily detachable manner, and attaches said end of said linkage rod to said hook in a readily detachable manner.

11. An engine choke actuation system as in claim 1, wherein said linkage rods interconnect said choke devices in a manner such that a plurality of said choke devices are moved to said open position with said with said detachable end inserted into said hook.

12. An engine choke actuation system for use with a plurality of choke devices comprising a linkage which interconnects said choke devices so as to operate said choke devices generally in unison, said linkage comprising a plurality of interconnected linkage rods each of which connects to at least one of said choke devices to operate said choke devices between a closed position and an open position, means for manually operating said linkage to open at least a majority of said choke devices, a bracket interconnecting said choke devices together, and a hook being formed on said bracket to engage one of said linkage rods and hold it in a position to open at least one choke valve, wherein said plurality of choke devices are aligned above one another in a generally vertical orientation, and said means for manually operating said linkage operates in connection with an uppermost choke device of said plurality of said choke devices.

13. An engine choke actuation system as in claim 12, wherein said means for manually operating said linkage opens all of said choke devices except said uppermost choke device.

14. A method for manually operating an engine choke actuation system comprising a linkage interconnecting a plurality of choke devices, said linkage comprising a plurality of choke levers interconnected by linkage rods, said choke levers operating choke shafts of the choke devices to operate said choke devices between an open and closed is position, said method comprising the steps of disconnecting one end of one of a linkage rod of said linkage from a choke lever of said linkage, moving the disconnected end to a position near a hook of the engine choke actuation system to open at least some of said choke devices, and engaging the disconnected end with said hook.

* * * * *

UNITED STATES PATENT AND TRADEMARK OFFICE

CERTIFICATE OF CORRECTION

PATENT NO. : 5,827,455

DATED : October 27, 1998

INVENTOR(S) : Hiroshi Nakai

It is certified that error appears in the above-indentified patent and that said Letters Patent is hereby corrected as shown below:

In Claim 14, at column 12, lines 4-5, "closed is position" should be --closed position--.

Signed and Sealed this

Twenty-sixth Day of October, 1999

*Attest:*

Q. TODD DICKINSON

*Attesting Officer*

*Acting Commissioner of Patents and Trademarks*